US006572194B2

(12) United States Patent
True

(10) Patent No.: US 6,572,194 B2
(45) Date of Patent: Jun. 3, 2003

(54) CHAIR ARM HAVING A REMOVABLE DECORATIVE PANEL

(75) Inventor: Roy A. True, Rancho Santa Margarita, CA (US)

(73) Assignee: True Seating Concepts, LLC. (MU)

( * ) Notice: Subject to any disclaimer, the term of this patent is extended or adjusted under 35 U.S.C. 154(b) by 0 days.

(21) Appl. No.: 09/760,555

(22) Filed: Jan. 17, 2001

(65) Prior Publication Data

US 2002/0093238 A1 Jul. 18, 2002

(51) Int. Cl.[7] ..... A47C 7/54

(52) U.S. Cl. ..... 297/411.2; 297/411.46; 297/411.45; 297/463.2; 297/227; 40/320; D6/501

(58) Field of Search ..... 297/227, 463.1, 297/463.2, 181, 411.2, 411.46, 411.45; D6/501, 500, 379; 40/727, 320

(56) References Cited

U.S. PATENT DOCUMENTS

| | | | | | |
|---|---|---|---|---|---|
| 1,094,154 | A | * | 4/1914 | Furge | 40/320 |
| 1,394,881 | A | * | 10/1921 | Bardera | 40/320 |
| 1,489,113 | A | * | 4/1924 | Brookbank | 40/320 |
| 4,186,964 | A | * | 2/1980 | Marrujo et al. | 297/422 |
| 6,033,013 | A | * | 3/2000 | Lee | 297/115 |

* cited by examiner

*Primary Examiner*—Peter M. Cuomo
*Assistant Examiner*—Stephanie Harris
(74) *Attorney, Agent, or Firm*—Morland C. Fischer

(57) ABSTRACT

A chair arm having a removable decorative panel to permit the appearance of the chair to be easily changed to adapt to a variety of decors. The arm includes a frame having a channel running along the opposite sides thereof. The decorative panel is slidably received by the arm at the channel within the frame. The decorative panel has a color and/or texture that is chosen to coordinate with a room or office decor. After the decorative panel is pushed into the frame, an arm rest is secured to the top of the frame to prevent a removal of the panel therefrom. The decor of the panel is visible within a window surrounded by the frame.

7 Claims, 3 Drawing Sheets

CHAIR ARM HAVING A REMOVABLE DECORATIVE PANEL

BACKGROUND OF THE INVENTION

1. Field of the Invention

This invention relates to arms attached to home and office chairs. More particularly, the invention relates to chair arms having removable panels that can be readily changed to coordinate the chairs with different decorative schemes.

2. Background Art

Chair arms are typically fabricated from metal, plastic or a similar rigid material. They may incorporate decorative trim, panels or coverings. Typically a user purchases chairs to match the decor of the room or office of intended use. Chairs have a relative long useful life and are impervious to decor changes within the office or home. While the decor of an office or home may be changed from, for example, traditional to modern or ultra modern, or the wall paneling in an office may be changed from one type of wood to another or from dark to light, the decorative trim and coloring of the chairs remains unchanged and, consequently, may clash with the new room decor.

There is a need for the trim and color of office chairs to be coordinated with other elements of the decor of the office, such as wall paneling, furniture, counter tops, window blinds drapes and rugs. Rather than discarding the old chairs or purchasing new chairs when office or home decors are changed, it would be desirable for the chairs to incorporate the same or coordinating decorative features as the new decor of the room in which the chair will placed or relocated. Also desirable is a trim and/or panel that is relatively easy and inexpensive to replace in a chair to which it is attached. Accordingly, what is needed is an efficient means to eliminate the clashes between existing chairs and new room or office decors by providing a decorative panel for the arm of a chair that can be quickly and inexpensively changed to match the new decor.

SUMMARY OF THE INVENTION

In general terms, an adaptable decorative chair arm is disclosed which allows the appearance of the arm, and thus the chair to which it is attached, to be changed to match the decor of the area or room in which the chair is to be used. The arm includes a vertically upright frame that has a channel running along the interior sides and bottom thereof. An armrest is axially aligned with and removably attached to a horizontal cap located at the top of the frame. A rectangular slot is formed through the cap to communicate with the channel of the frame.

A decorative panel, having a color, material or texture chosen to match the decor of choice, is pushed downwardly through the slot in the cap at the top of the frame so as to be slidably received by the channel in the frame. The armrest is then connected to the cap to hold the decorative panel in place within the arm. The armrest may later be removed and the original decorative panel pulled outwardly from the frame in order to be replaced by a different decorative panel to permit the decor of the chair to be changed on an as-needed basis. The decor of the panel is visible to onlookers at a window that is surrounded by the chair frame.

DETAILED DESCRIPTION

Figure 1:
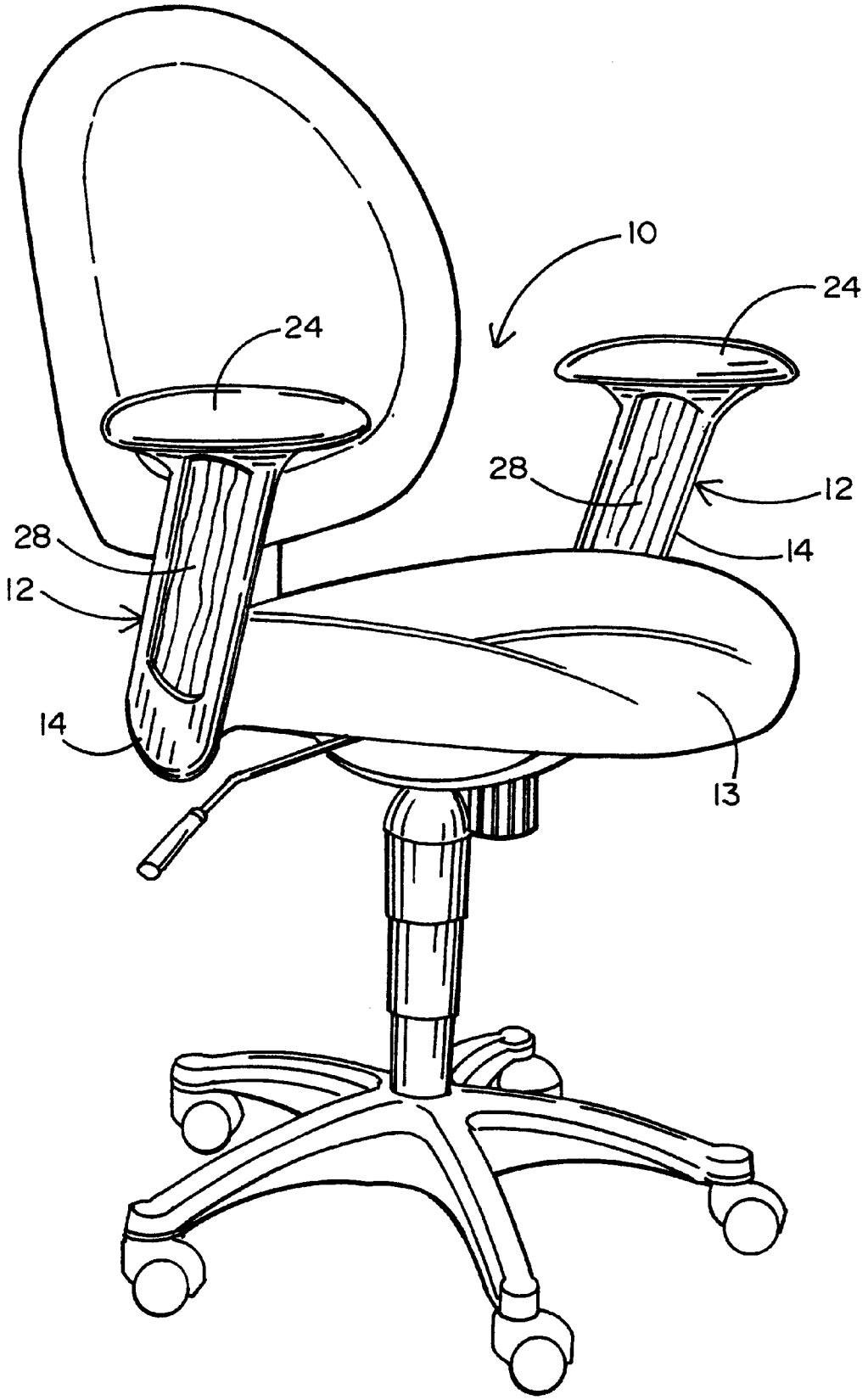
FIG. 1 is an overall perspective view showing a typical office chair with each arm having a removable decorative panel according to this invention.
Figure 2:
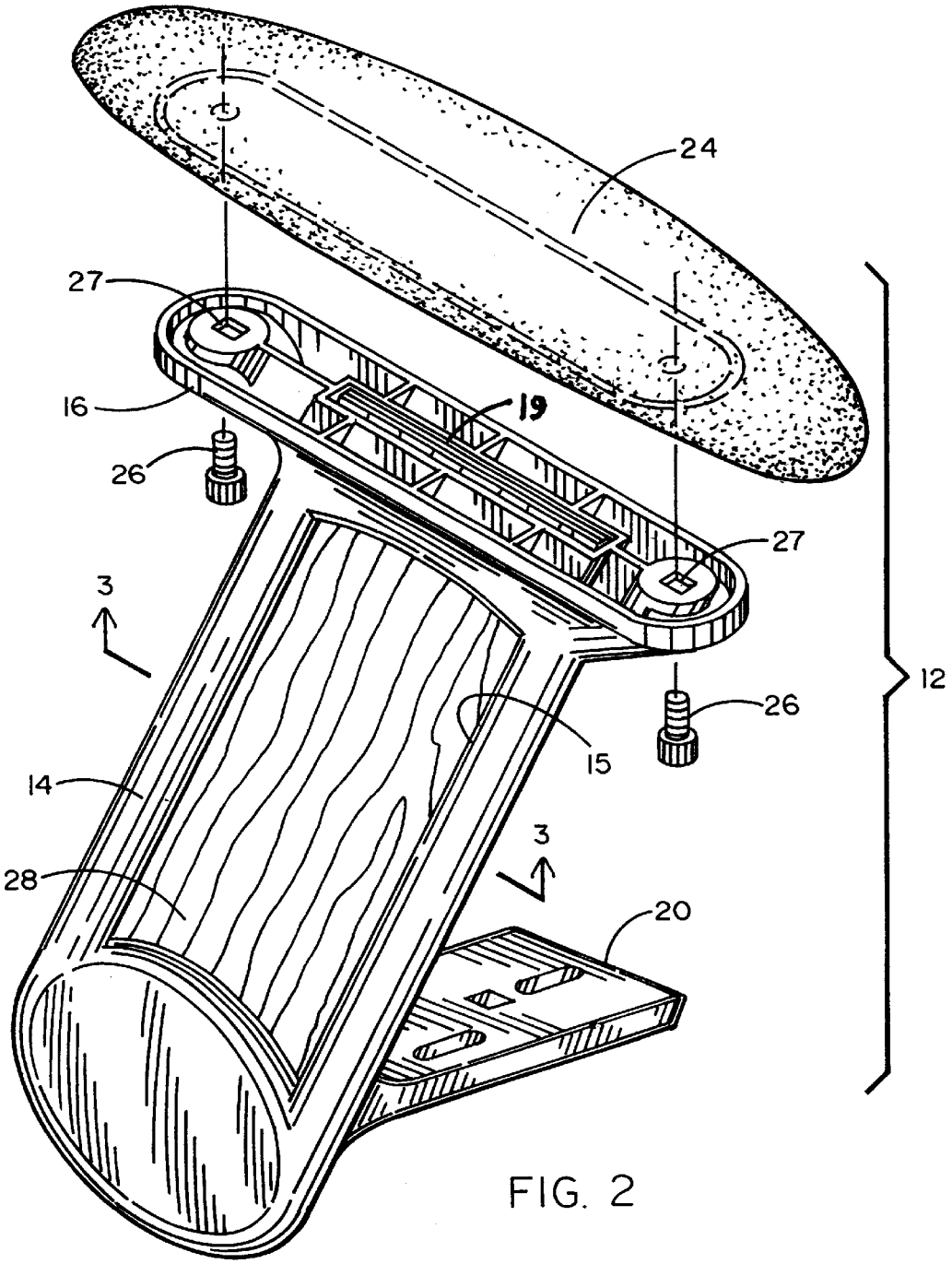
FIG. 2 is a partially exploded view of an arm of the chair of FIG. 1.
Figure 3:
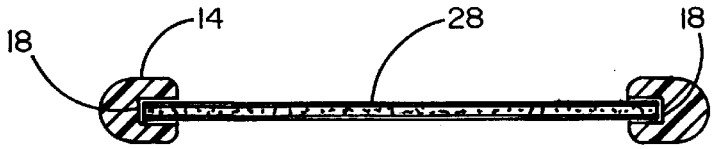
FIG. 3 is a cross-section taken along lines 3—3 of FIG. 2.

Referring concurrently to FIGS. 1–3 of the drawings, there is shown a typical office chair 10. The office chair 10 has arms 12 that are attached, in this embodiment, at opposite sides of the seat 13 of the chair. Each arm 12 includes a vertically upright frame 14, a window 15 surrounded by the frame, a horizontal cap 16 affixed to and extending across the top of the frame, and a connecting base 20 extending outwardly from the bottom of the frame 14 by which to connect the arm 12 to the seat 13 of the chair 10. A channel 18 (best shown in FIGS. 3 and 4) runs continuously along the frame 14 between the bottom thereof and a rectangular slot 19 formed in the cap 16. An armrest 24 is secured above the cap 16 by removable fasteners 26 that pass through holes 27 in the cap for receipt by corresponding receptacles formed in the bottom of the armrest 24.

In accordance with the present invention, a decorative panel 28 is removably received within the frame 14 so as to be visible at the window 15 that is surrounded by the frame. The decorative panel 28 is typically either a natural or simulated wood panel or a metal or plastic panel of a color and/or texture that is chosen to match the decor of the room in which the chair will be used. The decorative panel 28 is slidably received within the frame 14 by way of the channel 18 (best shown in FIG. 3) that runs continuously from the slot 19 in cap 16 downwardly along the opposite sides to the bottom of the frame.

Figure 4:
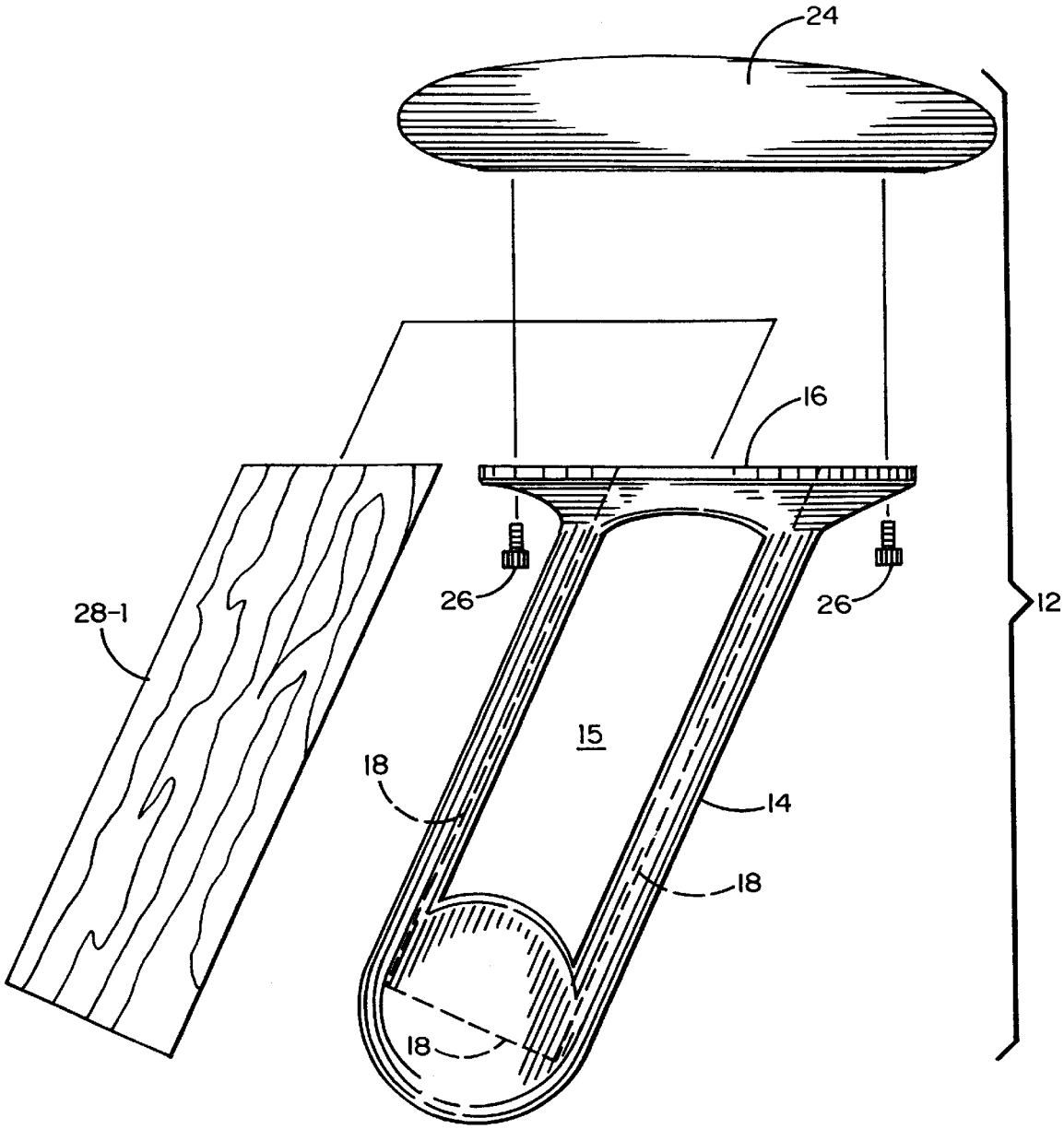
FIG. 4 is an exploded view of one of the arms of the chair of FIG. 1.

Installation and removal of the decorative panel 28 relative to the arm 12 of chair 10 is now described while referring to FIG. 4. The fasteners 26 are first removed and the armrest 24 is lifted off of the cap 16 at the top of the frame 14. Next, the original decorative panel 28 is pulled upwardly along the channel 18 in frame 14 and outwardly through the slot 19 in the cap 16. A different decorative panel 28-1 is then inserted into the slot 19 and pushed downwardly into the frame 14 via channel 18. The armrest 24 is returned to the cap 16 at the top of frame 12 where it is secured in place by means of the fasteners 26. This process of removing and substituting one decorative panel 28-1 for another may be repeated as often as is necessary, depending upon the location of the chair.

Accordingly, it can be appreciated that, by virtue of this invention, a chair arm is provided with an easily interchangeable decorative panel allowing the chair to be quickly and easily adapted to changing home, office and room decors. As such, the useful life of the chair is greatly extended. The interchangeable panels can be fabricated from any suitable material and textured or colored to match furniture and wall paneling, thus affording decorators and home owners a great flexibility is adapting chairs that contain the arm of the invention to any decorating scheme.

Although the description above contains many specificities, these should not be construed as limiting the scope of the invention but as merely providing illustrations of some of the presently preferred embodiments of this invention. Various other embodiments and ramifications are possible without changing the scope of the invention. For example, it may be advantageous to incorporate interchangeable arm panels of different shapes, for instance, round, oblong, square or irregular by making simple modification of the frame geometry. What is more, this invention can be applied to chairs of different styles and functions and is not limited to the office chair illustrated in the figures.

I claim:

1. An arm for attachment to a chair, comprising:

a frame having a top, a bottom and opposite sides surrounding a window through said frame;

a channel running through said frame between the top and the bottom thereof and extending along said opposite sides;

a first decorative panel removably received by said frame and slidably received in said channel, said decorative panel having a particular decor so as to be visible in the window of said frame; and an armrest detachable connected to said frame at the top thereof to cover said channel and prevent the removal of said first decorative panel therefrom.

2. The arm for attachment to a chair as recited in claim 1, wherein said first decorative panel has a particular color to match the decor of a room in which the chair is located.

3. Them for attachment to a chair as recited in claim 1, wherein said first decorative panel has a particular texture to match the decor of a room in which the chair is located.

4. The arm for attachment to a chair as recited in claim 1, wherein said first decorative panel is manufactured from wood.

5. The arm for attachment to a chair as recited in claim 1, wherein said first decorative panel is manufactured from plastic.

6. The arm for attachment to a chair as recited in claim 1, wherein said frame stands vertically upright along said arm when said arm is attached to a chair.

7. The arm for attachment to a chair as recited in claim 1, further comprising a different decorative panel to be received by said frame and substituted for said first decorative panel after said first decorative panel has been removed from said frame by way of said channel.

* * * * *